United States Patent [19]

Santanam et al.

[11] Patent Number: 5,024,170

[45] Date of Patent: Jun. 18, 1991

[54] EXTERNAL COMBUSTOR FOR GAS TURBINE ENGINE

[75] Inventors: Chandran B. Santanam; William H. Thomas, both of Indianapolis; Emil R. DeJulio, Columbus, both of Ind.

[73] Assignee: General Motors Corporation, Detroit, Mich.

[21] Appl. No.: 576,026

[22] Filed: Aug. 31, 1990

[51] Int. Cl.[5] ..... F23D 1/02

[52] U.S. Cl. ..... 110/264; 60/39.464; 110/347

[58] Field of Search ..... 110/264, 347, 265, 266; 60/39.464; 431/173

[56] References Cited

U.S. PATENT DOCUMENTS

| | | | |
|---|---|---|---|
| 2,945,459 | 7/1960 | Junkermann . | |
| 4,002,127 | 1/1977 | Angus | 110/8 |
| 4,146,359 | 3/1979 | Lumpkin et al. | 110/264 X |
| 4,337,032 | 6/1982 | Duplouy et al. | 432/106 |
| 4,351,251 | 9/1982 | Brashears | 110/261 |
| 4,569,295 | 2/1986 | Skoog | 110/347 |
| 4,584,948 | 4/1986 | Syred et al. | 110/264 |
| 4,624,191 | 11/1986 | Zauderer et al. | 110/264 |
| 4,683,541 | 7/1987 | David | 364/500 |
| 4,850,288 | 7/1989 | Hoffert et al. | 110/214 |
| 4,920,898 | 5/1990 | Solbes et al. | 110/265 |

*Primary Examiner*—Edward G. Favors
*Attorney, Agent, or Firm*—Saul Schwartz

[57] ABSTRACT

An external combustor for a gas turbine engine has a cyclonic combustion chamber into which combustible gas with entrained solids is introduced through an inlet port in a primary spiral swirl. A metal draft sleeve for conducting a hot gas discharge stream from the cyclonic combustion chamber is mounted on a circular end wall of the latter adjacent the combustible gas inlet. The draft sleeve is mounted concentrically in a cylindrical passage and cooperates with the passage in defining an annulus around the draft sleeve which is open to the cyclonic combustion chamber and which is connected to a source of secondary air. Secondary air issues from the annulus into the cyclonic combustion chamber at a velocity of three to five times the velocity of the combustible gas at the inlet port. The secondary air defines a hollow cylindrical extension of the draft sleeve and persists in the cyclonic combustion chamber a distance of about three to five times the diameter of the draft sleeve. The hollow cylindrical extension shields the drive sleeve from the inlet port to prevent discharge of combustible gas through the draft sleeve.

5 Claims, 2 Drawing Sheets

EXTERNAL COMBUSTOR FOR GAS TURBINE ENGINE

The invention herein described was made in the course of work under a contract or subcontract thereunder with the United States Department of Energy.

FIELD OF THE INVENTION

This invention relates to external combustors for gas turbine engines.

BACKGROUND OF THE INVENTION

U.S. patent application No. 4,768,446 issued 6 Sept. 1988 to Wilkes et al and assigned to the assignee of this invention describes an external combustion system for a gas turbine engine. The combustion system has a pulverized coal fueled rich zone combustor, a quench stage, an inertial particle separator for removing heavy solids and ash from the combustion products of the rich zone combustor, a cyclone separator for removing finer solids and ash from the combustion products of the rich zone combustor, a lean zone combustor, and a dilution stage for cooling the combustion products of the lean zone combustor to a turbine inlet temperature compatible with current gas turbine engine technology. An external combustor according to this invention incorporates in a single unit the cyclone separator, the lean zone combustor, and the dilution stage to achieve manufacturing economy.

SUMMARY OF THE INVENTION

This invention is a new and improved external combustor for a gas turbine engine. The external combustor according to this invention has a cyclonic combustion chamber defined by a cylindrical side wall closed at one end by a circular end wall and at the other end by a conical wall. The cyclonic combustion chamber has a tangential inlet port near the circular end wall and a draft sleeve centered in the circular end wall for hot gas discharge. Combustible gas with entrained solids is mixed with secondary air at the inlet port to the cyclonic combustion chamber and the combustible mixture swirls in a primary spiral along the cylindrical side wall toward the conical wall. Additional secondary air is admitted to the cyclonic combustion chamber in a higher velocity from an annulus around the inboard end of the draft sleeve. The annular column of high velocity air persists in the form of a hollow cylinder in the cyclonic combustion chamber to a depth of about 3–5 times the diameter of the draft sleeve before dissipating. The annular column shields the inboard end of the draft sleeve from the inlet port to prevent out-flow of unburned combustible mixture through the draft sleeve. The primary swirl is squeezed toward the center of the cyclonic combustion chamber near the conical wall and flows upward toward the inboard end of the draft sleeve. The flow of hot gas combustion products toward the draft sleeve is confined to the inside of the annular column of high velocity air emanating from the annulus around the inboard end of the draft sleeve. The draft sleeve is perforated to admit dilution air for cooling the products of combustion flowing through the draft sleeve.

BRIEF DESCRIPTION OF THE DRAWINGS

Referring to FIGS. 1–2, a schematically illustrated external combustor (10) according to this invention includes a combustor housing defining a cyclonic combustion chamber (12) bounded on the side by a refractory lined cylindrical side wall (14), on the top by a refractory lined circular end wall (16), and on the bottom by a refractory lined conical wall (18). The cyclonic combustion chamber (12) is symmetrical about a vertical centerline (20) of the external combustor (10). A pressure sealing gate (22) at the bottom of the conical wall (18) defines a solids trap or discharge from the cyclonic combustion chamber (12).

Figure 1:
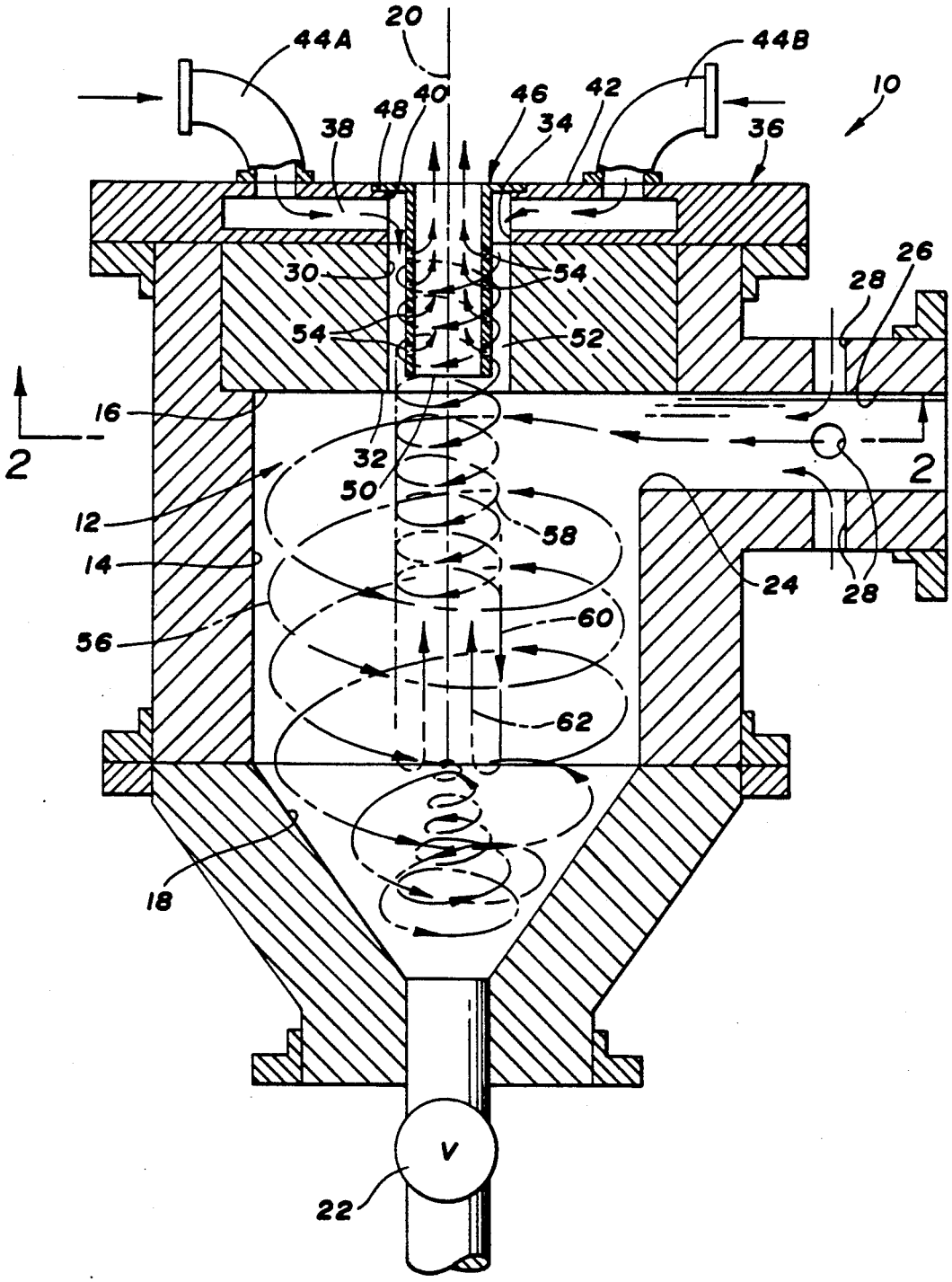
FIG. 1 is schematic elevational sectional view of an external combustor according to this invention.

The external combustor (10) has an inlet port (24) to the cyclonic combustion chamber (12) adjacent the end wall (16). An inlet passage (26) behind or upstream of the inlet port (24) conducts a continuous stream of combustible gas with solids such as ash entrained therein from an upstream source, not shown, to the inlet port. The combustible gas may, for example, be generated by combustion of coal in a rich zone combustor such as described in the aforesaid U.S. Pat. No. 4,768,446. The inlet passage (26) has a plurality of secondary air orifices (28) upstream of the inlet port (24) connected to a source of compressed air, not shown.

A cylindrical passage (30) in the combustor housing of the external combustor (10) is aligned on the centerline (20) and opens into the cyclonic combustion chamber (12) at a circular inboard end (32). The cylindrical passage is aligned with a lower circular aperture (34) in a generally flat secondary air plenum housing (36) at the top of the external combustor (10). The lower aperture (34) opens into a round, flat secondary air plenum (38) aligned on the centerline (20). The plenum housing (36) has an upper circular aperture (40) in an upper wall (42) of the housing aligned on the centerline (20). A pair of secondary air ducts (44A–B) are connected to a source of compressed air, not shown, and to the upper wall (42) of the plenum housing (36) and discharge high velocity jets of compressed air tangentially into the secondary air plenum (38) to establish high velocity, circular airflow in the latter. Alternatively, the ducts (44A–B) may discharge compresssed air into the plenum (38) without establishing circular flow therein.

Figure 2:
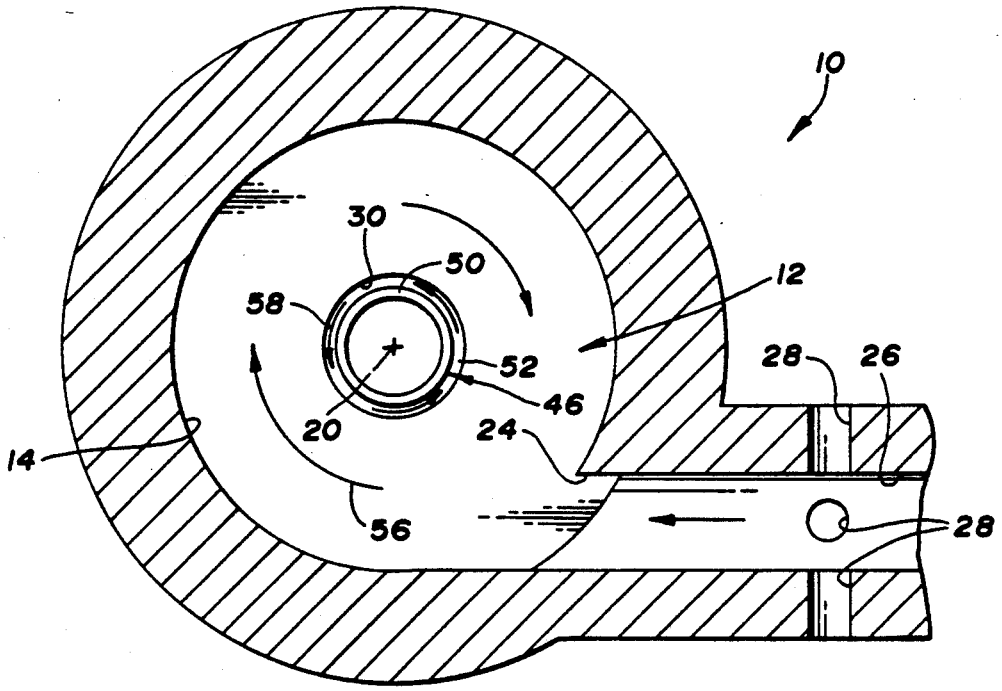
FIG. 2 is a schematic sectional view taken generally along a plane indicated by lines 2–2 in FIG. 1.

As seen best in FIGS. 1 and 2, the external combustor (10) further includes a cylindrical draft sleeve (46) aligned on the centerline (20). The draft sleeve (46) has an annular flange (48) at an outboard end which closes the upper aperture (40) in the plenum housing (36) and at which the draft sleeve is rigidly attached to the plenum housing. The draft sleeve (46) extends through the lower aperture (34) and into the cylindrical passage (30) to an inboard end (50) generally flush with the end wall (16) of the cyclonic combustion chamber (12). The diameters of the lower aperture (34) and of the cylindrical passage (30) exceed the diameter of the draft sleeve (46) so that an annulus (52) is defined around the draft sleeve. The annulus (52) communicates at one end with the secondary air plenum (38) and at the other end with the cyclonic combustion chamber (12). The draft sleeve is perforated by a plurality of dilution orifices (54) open to the annulus (52).

The external combustor (10) operates as follows. A continuous stream of hot combustible gas with entrained solids is conducted by the inlet passage (26) toward the inlet port (24) at a velocity of about 60–100 ft/sec. At the secondary air orifices (28), additional or secondary combustion air mixes with the fast flowing stream of combustible gas and entrained solids and the mixtures discharges through the inlet port (24) tangentially into the cyclonic combustion chamber (12). The mixture swirls in a primary spiral (56) along the side wall (14) toward the conical wall (18) with a stable, spontaneous ignition flame, not shown, in the cyclonic combustion chamber likewise circulating in the primary spiral. The solids entrained in the combustible gas stream, as well as ash from combustion in the cyclonic combustion chamber (12) are inertially separated from the hot gas products of combustion in the cyclonic combustion chamber and are collected at and discharged through the solids trap defined by the gate (22).

At the same time, additional secondary air from the secondary air plenum (38) flows from the latter to the cyclonic combustion chamber (12) through the annulus (52). The additional secondary air issues from the annulus in a high velocity secondary spiral swirl (58) counter to the primary swirl (56). In an alternate embodiment, not shown, the secondary swirl (58) may be in the same direction as the primary swirl (56). In another alternate embodiment, not shown, which has been preliminarily successful in laboratory testing, the compressed air may issue from the annulus (52) into the combustion chamber (12) without any swirl at all.

In any of the above referenced alternate embodiments, the velocity of the compressed air issuing from the annulus (52) is on the order of between three and five times the velocity of the mixture entering the combustion chamber (12) through the inlet port (24). The air enters the cyclonic combustion chamber 12 as a hollow cylinder and persists in the cyclonic combustion chamber beyond the end wall (16) for a distance of on the order of three to four times the diameter of the draft sleeve. The hollow air cylinder defines an extension (60) of the draft sleeve (46) beyond the end wall (16) which effectively prevents direct passage of combustible mixture from the inlet port into the inboard end of the draft sleeve.

At the lower end of the cyclonic combustion chamber (12), the conical wall (18) squeezes the primary spiral (56) toward the centerline (20). The gate (22) closing the lower end of the cyclonic combustion chamber causes the primary spiral to reverse longitudinal direction and flow upward along the centerline toward the inboard end (50) of the draft sleeve (46). Similarly, the secondary spiral (58) dissipates in the lower region of the cyclonic combustion chamber and combines with the upward flow of the primary spiral into a hot gas discharge stream (62) for exit from the cyclonic combustion chamber through the inboard end (50) of the draft sleeve. The cohesive or in-tact portion of the secondary spiral (58) forming the draft sleeve extension (60) effectively confines the hot gas discharge stream (62) and directs the latter into the draft sleeve.

The hot gas discharge stream flows up through the draft sleeve toward the outboard end thereof. Concurrently, relatively cooler air enters the draft sleeve from the annulus (52) through the dilution orifices (54) in the sleeve and mixes with and cools the hot gas discharge stream to a temperature compatible with current gas turbine engine materials technology. The cooled and diluted hot gas discharge stream flows out of the draft sleeve (46) through the outboard end thereof to a device, not shown, such as a nozzle ring of a gas turbine engine. Concurrently, the secondary air flowing in the annulus (52) cools the draft sleeve (46) for enhanced durability of the latter.

Figure 3:
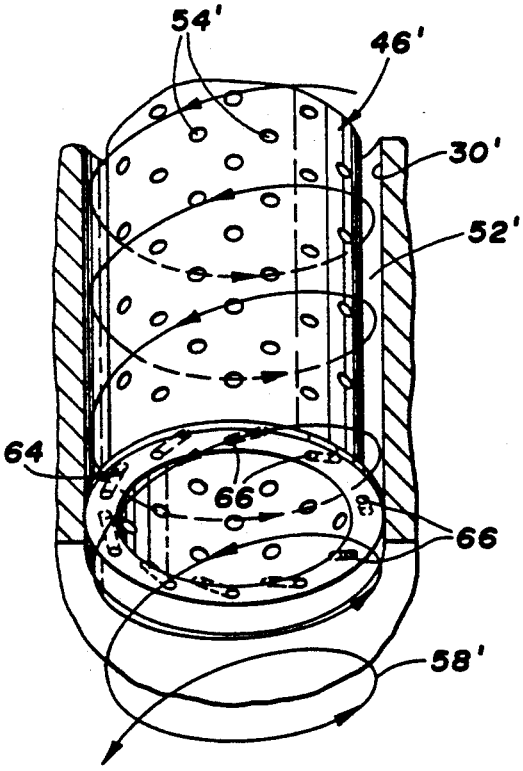
FIG. 3 is an enlarged perspective view of a portion of a first modified external combustor according to this invention.

Referring to FIG. 3, a schematically illustrated first modified draft sleeve (46′) is disposed in the cylindrical passage 30′. The modified draft sleeve (46′) has an annular air dam (64) at the inboard end thereof which closes the inboard end of the annulus (52′). The air dam (64) has a plurality of angle drilled holes (66) therethrough which discharge secondary air into the cyclonic combustion chamber in a corresponding plurality of high velocity tangential jets. The tangential jets combine to form a secondary spiral swirl (58′) counter to the primary swirl in the cyclonic combustion chamber. In addition, the air dam (64) may increase the pressure gradient across the draft sleeve (46′) for enhanced flow of dilution air through the dilution orifices (54′) in the draft sleeve.

Figure 4:
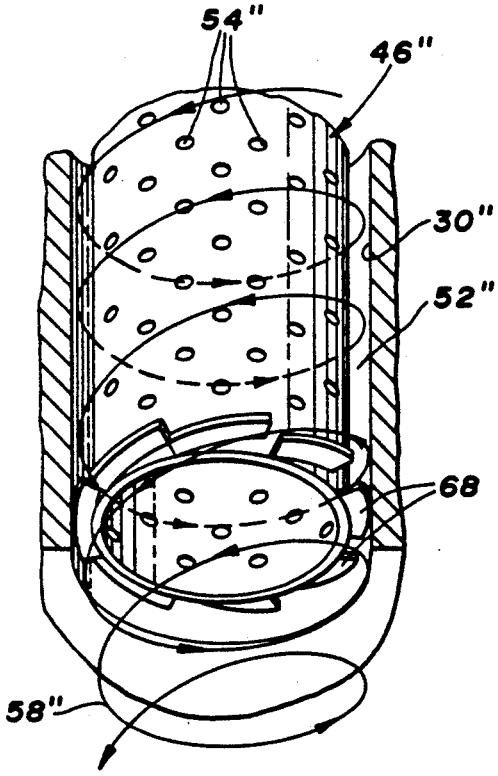
FIG. 4 is an enlarged perspective view of a portion of a second modified external combustor according to this invention.

Referring to FIG. 4, a schematically illustrated second modified draft sleeve (46″) is disposed in the cylindrical passage (30″). The second modified draft sleeve (46″) has a stage of swirler vanes (68) at the inboard end thereof in the annulus (52″). The swirler vanes intercept the air flow in the annulus toward the cyclonic combustion chamber and redirect the flow into a more well defined secondary spiral swirl (58″). In addition, the swirler vanes (68) may also increase the pressure gradient across the draft sleeve (46″) for enhanced flow of dilution air through the dilution orifices (54″) in the draft sleeve.

We claim:

1. An external combustor comprising:

a combustor housing with a cyclonic combustion chamber therein defined by a cylindrical side wall aligned on a vertical centerline of said housing and closed on top by a circular end wall and closed on the bottom by a conical wall, means defining an inlet port through said cylindrical side wall adjacent said circular end wall for discharging into said cyclonic combustion chamber a combustible gas with solids entrained therein at a predetermined velocity generally tangent to said cylindrical side wall whereby a primary spiral swirl of combustion products and entrained solids is established in said cyclonic combustion chamber from said circular end wall toward said conical wall, said entrained solids being inertially separated from said primary spiral swirl and said conical wall squeezing said primary spiral swirl toward said vertical centerline and reversing the longitudinal flow direction thereof toward said circular end wall, means defining a cylindrical passage in said combustor housing aligned on said vertical axis and opening into said cyclonic combustion chamber through said circular end wall, a metal draft sleeve supported on said combustor housing in said cylindrical passage and cooperating therewith in defining an annulus between said cylindrical passage and said draft sleeve opening into said cyclonic combustion chamber through said circular end wall, said draft sleeve opening into said cyclonic combustion chamber for conducting therefrom a hot gas discharge stream and having an inboard end generally flush with said cylindrical end wall, means for introducing secondary air into said cyclonic combustion chamber through said annulus at a velocity of between about three and five times said predetermined velocity whereby said secondary air defines a hollow cylindrical extension of said draft sleeve from said inboard end thereof into said cyclonic combustion chamber a distance of between about three and five times said diameter of said draft sleeve, and means for diverting a portion of said secondary air from said annulus into said draft sleeve to dilute and cool said hot gas discharge stream therein.

2. The external combustor recited in claim 1 wherein said means for diverting a portion of said secondary air from said annulus into said draft sleeve to dilute and cool said hot gas discharge stream therein includes:

means defining a plurality of perforations in said draft sleeve exposed on one side to said annulus and on the other side to the interior of said draft sleeve.

3. The external combustor recited in claim 2 and further including:

means for imparting a secondary spiral swirl to said secondary air entering said cyclonic combustion chamber through said annulus.

4. The external combustor recited in claim 3 wherein said means for imparting a secondary spiral swirl to said secondary air entering said cyclonic combustion chamber through said annulus includes:

means defining an air dam in said annulus generally at said circular end wall of said cyclonic combustion chamber, and means on said air dam defining a plurality of orifices therethrough oriented generally tangent to said draft sleeve.

5. The external combustor recited in claim 3 wherein said means for imparting a secondary spiral swirl to said secondary air entering said cyclonic combustion chamber through said annulus includes:

means defining a stage of swirler vanes in said annulus generally at said circular end wall of said cyclonic combustion chamber.

* * * * *